US005172738A

United States Patent [19]

Komukai et al.

[11] Patent Number: 5,172,738

[45] Date of Patent: Dec. 22, 1992

[54] FUELLING APPARATUS

[75] Inventors: Shigemi Komukai, Yokohama; Yutaka Nagahisa, Ebina, both of Japan

[73] Assignee: Tokico Ltd., Kanagawa, Japan

[21] Appl. No.: 582,324

[22] Filed: Sep. 13, 1990

[30] Foreign Application Priority Data

Sep. 20, 1989 [JP] Japan ..... 1-243627

[51] Int. Cl.[5] ..... B65B 3/26

[52] U.S. Cl. ..... 141/83; 141/1

[58] Field of Search ..... 141/83, 94, 95, 1, 5

[56] References Cited

U.S. PATENT DOCUMENTS

| | | | |
|---|---|---|---|
| 4,359,074 | 11/1982 | Maruyama et al. | 141/94 |
| 4,838,323 | 6/1989 | Watts | 141/1 |
| 4,934,419 | 6/1990 | Lamont et al. | 141/83 |
| 5,029,622 | 7/1991 | Mutter | 141/83 |

FOREIGN PATENT DOCUMENTS

| | | | |
|---|---|---|---|
| 2502134 | 9/1982 | France | 141/94 |
| 64-58697 | 3/1989 | Japan . | |
| 64-84895 | 3/1989 | Japan . | |
| 1-124598 | 5/1989 | Japan . | |

*Primary Examiner*—William A. Cuchlinski, Jr.
*Assistant Examiner*—G. Bradley Bennett
*Attorney, Agent, or Firm*—Scully, Scott, Murphy & Presser

[57] ABSTRACT

This invention relates to an apparatus: to determine the concentration of vehicular fuel vapor contained in a fuel tank of a vehicle; to examine the difference between the measured fuel vapor concentration and an internal reference standard based on the concentration of ambient vapors; to issue a warning to report an abnormality in the system if an unusual deviation, from the predetermined allowable range of differences, is detected therein; and to shut off the fuelling operation until the cause of the abnormality has been rectified.

10 Claims, 3 Drawing Sheets

FUELLING APPARATUS

BACKGROUND OF THE INVENTION

1. Field of the Invention

This invention relates to a fuelling apparatus used in fuel depots. It is particularly useful in preventing supplying incorrect type of fuel to a vehicle utilizing liquid type fuels from a pumping station.

2. Background Art

In general, in fuel depots, different types of fuels are supplied from different pumping stations, each equipped with a fuel flow meter and a nozzle to deliver the liquid fuel to a vehicle.

The fuelling operation incorporates steps to ascertain that the type of fuel, to be supplied to a particular vehicle, matches with that of the type of fuel contained in that particular station before the actual pumping operation can begin.

The procedure for deciding whether or not the fuel in the pumping station matches with that required by the vehicle is as follows:

A pumping station is equipped with two types of hoses extending side by side in parallel with each other; which are, 1. a hose to deliver the fuel to a fuel tank of a vehicle requiring the fuel, and 2. a hose to exhaust the vapors present in the said tank of the said vehicle.

Furthermore, each pumping station is equipped with two types of devices to carry out the objective of confirming that the fuel contained in the pumping station matches with the fuel requirement of the vehicle; the two types of devices are, 1. a sensing and measuring device, sometimes referred to as a sensor, to measure the concentration of the vapors emitted by the fuel, and 2. a device to identify the type of fuel based on the information obtained from the magnitude of the concentration determined by the said sensing device When a nozzle of the fuel supply pump is inserted into the fuel tank of a vehicle, the first step is the removal of the vapor from the fuel tank of the said vehicle through the vapor intake pipe, and the measurement of the concentration of the fuel vapor contained in the said tank, using the said sensing device.

Such sensors are often made of semiconducting metal oxide materials.

The said semiconducting metal oxide materials, referred to hereafter as oxide semiconductor, undergoes changes in the electrical conductivity when the vapor molecules are absorbed on the surface of the oxide semiconductor. The said identifying device determines the type of fuel in the fuel tank from the magnitude of the changes in the electrical conductivity which takes place on the said sensing device.

The conventional pumping stations have the following problems associated with their reliability.

The said identifying device determines the type of fuel based on the electrical output of the said sensing device, the magnitude of the signal therefrom is attained by electronic amplification of the signals from the said sensing device.

In general, gasolines produce high magnitude signals while light oils produce low magnitude signals. Therefore, based solely on the concentration factors, the said identifying device judges the fuel type to be gasoline when high magnitude signals are presented by the sensing device while the said identification device judges the vapor to be light oils when low magnitude signals are presented thereto.

This methodology, based solely on the magnitude of the signals, has a serious problem in accurately defining the type of fuel, because a malfunctioning electrical circuit may, at times, lead the identification device to interpret erroneously that low magnitude signal, produced by the defective circuit, is generated by a light oil.

SUMMARY OF THE INVENTION

This invention relates to a new type of pumping station having the capability of checking the operation of a sensor to ascertain its correct functioning at the time of every pumping operation.

To accomplish the above objective, a pumping station is constructed in the following manner.

The pumping station comprises;

(i) a vapor routing pipe whose one end is open at the tip of the nozzle and whose opposite end is connected to a fuel sampling device, and (ii) a sensor (hereafter referred to as a fuel vapor analyzer), located within the said vapor routing pipe, to measure the vapor coming from the fuel tank of a vehicle so as to measure the concentration of the fuel vapor emitted therefrom, and (iii) a sampling device to withdraw the vapor from the fuel tank of the said vehicle, and (iv) a device for measuring the standard concentration of vapors in the ambient atmosphere, and (v) a device for activating the said sampling device when all the necessary steps for fuelling have been completed, and (vi) a computing means for differentiating among the fuels based on the concentrations of the vapors, measured with the said fuel vapor analyzer, and (vii) a device to alert the fuelling operator, either before or after the fuelling operation, of any unusual deviation from the pre-determined, allowable range of deviation between the concentration of the vapors in ambient air and in the fuel tank, either at the beginning or the end of fuelling operation.

Furthermore, the said pumping station is comprised of the following:

(i) a vapor routing pipe whose one end is open at the tip of the nozzle and whose opposite end is connected to a fuel sampling device, and (ii) a device for measuring the vapor concentration with a sensor, located within the said vapor routing pipe, to measure the vapor coming from the fuel tank of a vehicle into which the nozzle of the said pumping station is inserted, and (iii) a device to operate a sampling pump in conjunction with magnetically controlled valves to admit a quantity of ambient atmosphere into the said vapor routing pipe and to exhaust a quantity of the sampled fuel vapor into the said routing pipe, in conjunction with magnetically controlled valves, to ultimately expel the sampled vapor from the open end of the vapor intake pipe, and (iv) a device within the said sampling device for measuring the standard concentration of vapors in the ambient atmosphere, and (v) a computing means 24 to differentiate among the fuels based on the concentration of the sampled vapors, measured with the said fuel vapor analyzer, and (vi) a computing means for performing the functions of;
(a) activating the said pump for suction and exhaustion of vapors, and
(b) connecting the intake opening of the said pump to the vapor routing pipe, and
(c) connecting the exhaust opening of the said pump to the vapor routing pipe by means of said valves; and after the completion the vapor concentration measurement by the fuel vapor analyzer, and
(d) activating the said flow pump for suction and expelling of ambient vapors, and
(e) connecting the intake side of the said pump to the vapor routing pipe by means of said valves; and
(f) expelling the reference vapor from the open end of the fuel vapor intake pipe.
(vii) a device to alert the fuelling operator, either before or after the fuelling operation, of any unusual deviation from the pre-determined, allowable range of deviation between the concentration of the vapors in ambient air and in the fuel tank.

According to the operation of such a pumping station, when an operator removes the pumping spout from the station and inserts it into the opening of the fuel tank of a vehicle, the vapor therefrom is drawn into the vapor routing pipe of the pumping station, and the concentration of the vehicle fuel is measured according to the procedure described above.

After the completion of the measurement of the concentration of the full vapor, the sampled vapor is expelled by the action of the sampling pump into the atmosphere outside the pumping station.

If the difference between the measured value of the fuel vapor and the reference value exceeds the preauthorized allowable range, the unusual condition is recognized and the operator is alerted.

By this procedure, it is possible to ascertain the proper functioning of the fuel vapor analyzer, and thereby to increase the reliability of the performance of a pumping station and to avoid the possibility of supplying incorrect type of fuel to a vehicle.

DETAILED DESCRIPTION OF THE PREFERRED EMBODIMENTS OF THE PRESENT INVENTION

In the following, the operation of a new pumping station is explained with reference to a preferred embodiment according to this invention. The example is a fixed, in-ground fuel storage type of pumping station.

Figure 1:
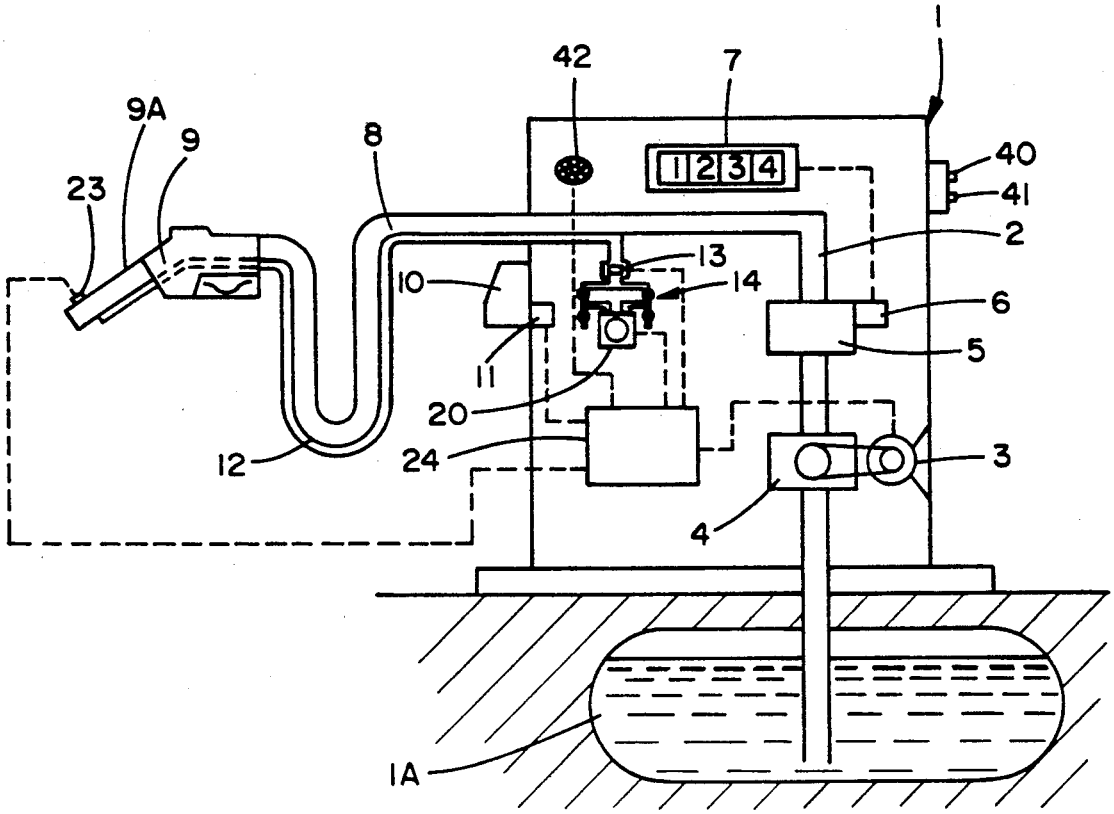
FIG. 1 shows a schematic view of the overall arrangement of a pumping stations.

FIG. 1 shows a schematic view of the overall arrangement of the present embodiment.

In this figure, a pumping station 1 having a fuel delivery line 2 is constructed within the property boundary. One end of the fuel delivery line 2 extends into a fixed, in-ground fuel storage tank 1A. In a section of the delivery line 2 is located a fuel pumping motor 3 which drives a pump 4 with which to drive a liquid flow meter 5. The flow meter 5 contains a pulse generator 6 which generates pulses proportional to the volume of the flowing liquid. On the exterior surface of the pumping station is located a cumulative flow meter 7 which measures the total volume of the fuel delivered.

A fuel supply hose 8 is attached to the opposite end of the delivery line 2. The fuel is delivered through the delivery line 2 to the fuel supply hose 8. A spout 9 for the delivery of fuel is attached to the opposite end of the fuel supply hose 8. The fuel, such as gasoline or light oil, is delivered from the spout 9 through the fuel supply hose 8 to a fuel tank of a vehicle (not shown).

The spout 9 is stored in a spout holder 10, when not in use to deliver a fuel. A nozzle switch 11 is attached to the spout holder 10, to activate the pumping action when the spout which forms a fuel delivery nozzle is taken off the storage, and to deactivate the switch when the spout is returned to the storage.

Following along the supply hose 8 is a vapor sampling pipe 12 whose one end is extended to the end of the spout 9, and further to the end of a delivery nozzle 9A. At the end of the said sampling pipe 12 is an opening for drawing the vapor from the fuel tank of the vehicle. The said opening acts also as the exhaust opening for expelling air which is drawn in from an ambient air intake opening 15B which will be described later.

The vapor sampling pipe 12 extends further into the interior of the pumping station 1, and incorporates a fuel vapor analyzer 13.

The fuel vapor analyzer 13 is comprised of a sensing material, such as metal oxide semiconductor whose electrical conductivity changes in some relationship with the quantity of substance absorbed on the surface, whereby the concentration of the said vapor can be determined from the changes in the electrical conductivity detected by the fuel vapor analyzer 13.

Figure 2:
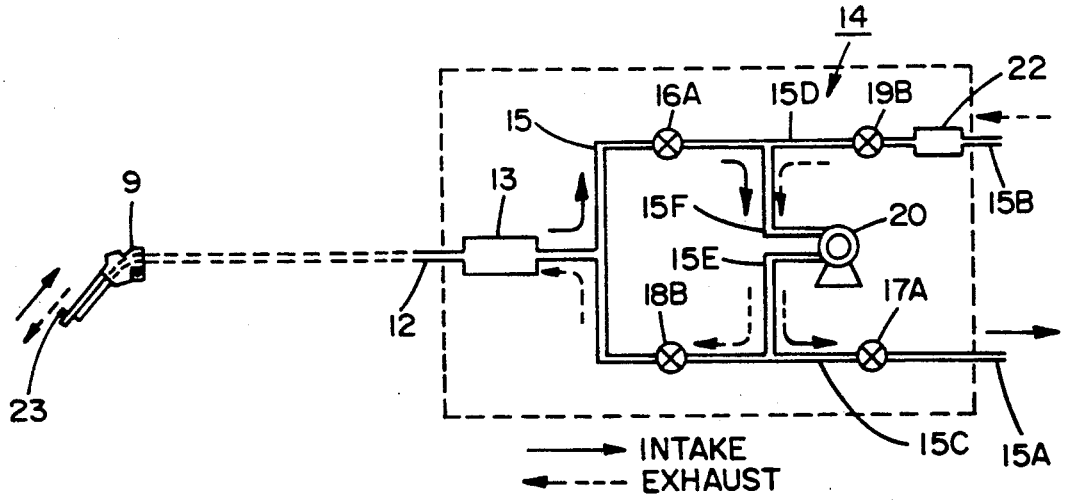
FIG. 2 shows the main components of the said pumping station.

Further into the interior end of the vapor sampling pipe 12, is located a sampling device 14, which delivers a sampling quantity of vapors into said analyzer 13, and, as shown in FIG. 2, comprises a vapor routing pipe 15; an exhaust opening 15A; an ambient air intake opening 15B; magnetic valves 16A, 17A, and 18B, and 19B; and a sampling pump 20.

The vapor routing pipe 15 separates into a routing pipe 15C which incorporates magnetic valves 17A, 18B, and into a routing pipe 15D which incorporates magnetic valves 16A and 19B.

The said magnetic valves are energized electrically by a computing means 24, to be explained later, which are arranged in a circuit (not shown) to activate the said valves according to the routing requirements of the sampling device 14. It is noted that the motive power for the device 14 can also be an ejector valve.

The routing pipe 15C is divided at its midpoint into a routing pipe 15E, one end of which is attached to a sampling pump 20; and the routing pipe 15D is divided into a routing pipe 15F, one end of which is also attached to the sampling pump 20. The sampling pump 20 is driven with an intake pump motor 21, and incorporates a section for transferring a sampling quantity of vapors into the fuel vapor routing pipes 15E and 15F.

The direction of the flow of fuel vapors into the sampling device 14 during the intake phase, is shown by solid arrows in FIG. 2; during this period, the valves 16A and 17A are opened while the valves 18B and 19B are closed, and the sampling motor 20 is rotated to enable a withdrawal of sample vapor through the end opening in vapor sampling pipe 12, located at the end of the delivery nozzle 9A.

The direction of the flow of ambient air into the sampling device 14 is shown by dotted arrows in FIG. 2; during this phase, the magnetic valves 16A and 17A are closed while the magnetic valves 18B and 19B are open, thereby permitting purging of the residual fuel vapors, remaining in the pipes into the ambient air, after passing through pipe 15D, the sampling motor 20 and through pipe 15C, consecutively.

The ambient air passes over an ambient vapor analyzer 22, located at the entrance to the routing pipe 15B, which analyzes the concentration of trace fuel vapors in the ambient atmosphere.

The signal from said analyzer 22 is forwarded to a programmable computer 26 (hereafter denoted by PC26) which constitutes the computing device for the present invention, stores the values of ambient vapor concentration as the standard reference, along with the values obtained by the fuel vapor analyzer 13. The PC26 calculates the difference between the two values, and compares the difference with the predetermined range of permissible differences between the two values.

A nozzle position sensor 23 is located at the end of the delivery nozzle 9A, and comprises, a light emitter and a light detector for example, so that the said sensor can determine whether or not the nozzle is in the fuelling position by the degree of brightness detected by the light sensing detector: high brightness indicates that the nozzle is not in the fuelling spout of a fuel tank of a vehicle while low brightness indicates that the nozzle is inserted into the fuelling spout of the said vehicle.

It is noted that the said position sensor can be made of other types of sensing devices, such as ultrasonic detectors.

Figure 3:
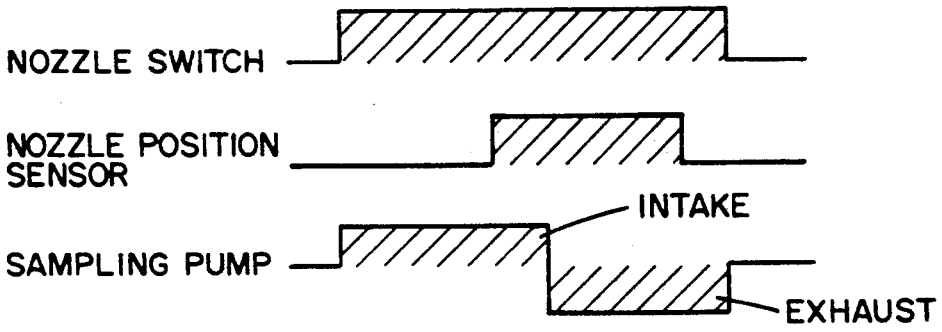
FIG. 3 shows a timing chart of the activity schedule of the exhaust pump.

The relative timing relationships of the three elements; the nozzle switch 11, the nozzle position sensor 23 and the sampling pump 20 are schematically illustrated in FIG. 3; the three horizontal time axes show relative durations of the three on/off signals, including the two phases, intake and exhaust phases, of the sampling motor 20.

Figure 4:
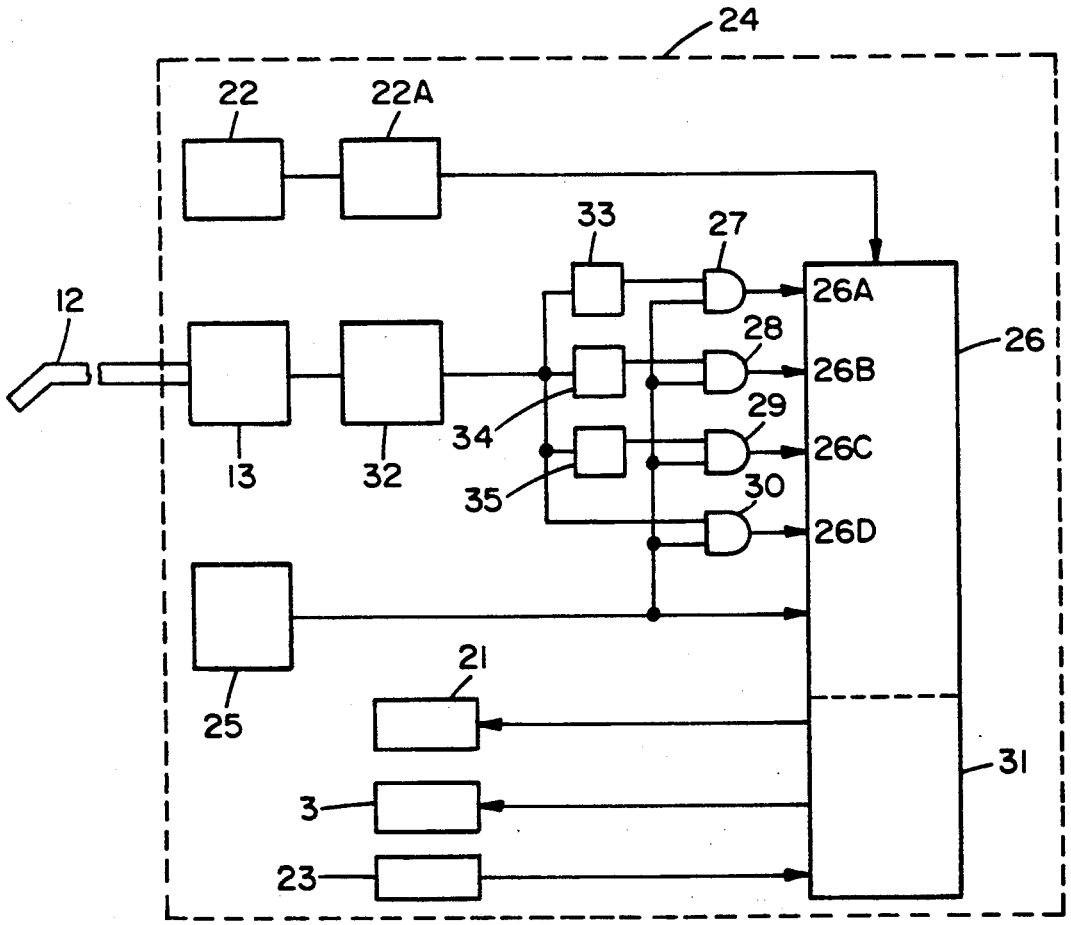
FIG. 4 shows a schematic of the controls for the vapor analyzer and the sampling pump.
Figure 5:
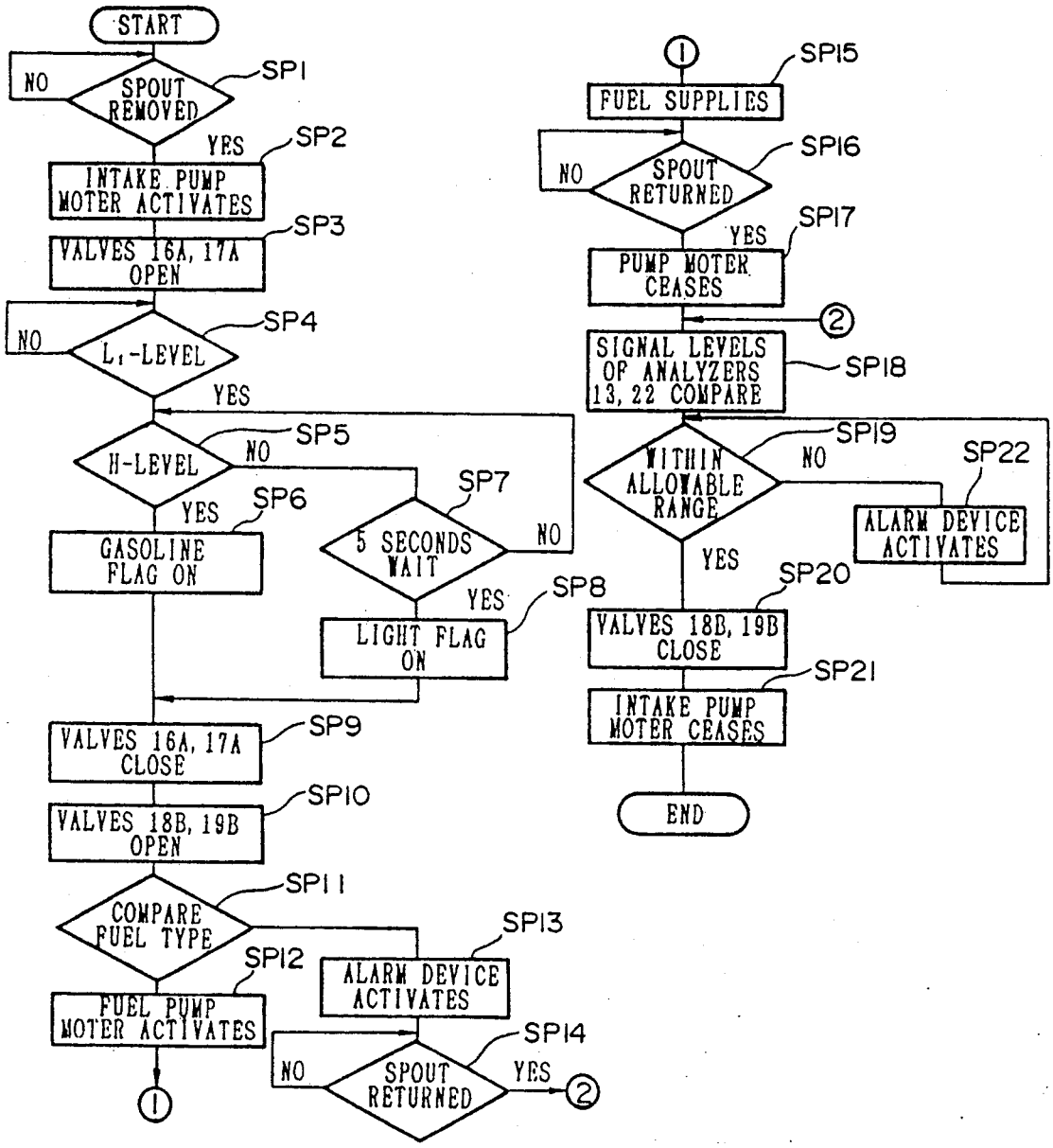
FIG. 5 is a logic flow chart depicting a typical operational sequence of the pumping station.

The primary components, of the computing means 24 are schematically shown in FIG. 4, wherein the main component comprises the computer PC26. Sampling pump and sampling of the ambient atmosphere, as described above, are controlled electrically by the computing means 24. The start/end analyzer 25 controls the initiation of a fuelling operation. The start signal from the nozzle switch 11 is activated by removing the spout 9 from the spout holder 10, and is forwarded to logic gates 27,28 and 29 of PC 26.

In the said PC26 is stored information concerning the type of fuel contained in the storage tank of the pumping station 1, a flag for gasoline which is activated when the fuel to be supplied is gasoline and a separate flag for light oil when the fuel to be supplied is light oil.

The power section 31 of the computing means 24 controls the activation of the sampling device 14 and sampling motor 20, to enable sampling of the fuel vapor, upon receiving an appropriate signal from the start/end analyzer 25.

In the meantime, if the vapor from the fuel tank is delivered to the fuel vapor analyzer 13, while the nozzle is being inserted into the spout as indicated by the signal generated by the nozzle position sensor 23, then the said analyzer 13 sends an appropriate analogue signal to a device to convert the analogue signals to digital signals (A/D converter). The said device, the fuel A/D converter 32, performs the main function of converting the fuel analogue signals to digital signals to initiate a series of events described below.

The fuel A/D signal converter 32 converts the analogue signal, representing the concentration of the fuel vapor from the fuel tank, generated by the fuel vapor analyzer 13, into digital signals which are sent to respective amplification circuits as follow; to an amplification circuit 33 which provides double amplification; to an amplification circuit 34 which provides quadruple amplification; to an amplification circuit 35 which provide a six-fold amplification; and to the input section of the and-gate 30.

In the above case, the respective voltages of the digital signals from the fuel A/D signal converter 32 are set at 5 volts and 1 volt, respectively, for gasoline vapor (a high limit) and for light oil (low limit).

The said amplification circuits 33, 34 and 35 are provided for to increase the detectivity of the fuel vapor analyzer 13.

Additionally, the ambient vapor analyzer 22, after having measured the concentration of the vapors in ambient air at the pipe 15D, sends the said analogue signal to PC 26 through an A/D converter 26A.

The converter 26A performs amplification and logic functions, in the same manner as the fuel A/D signal converter 32 previously described, by providing the necessary amplification of 2-fold, 4-fold and 6-fold increases of the signals as required, as well as sending the signals to the logic gates, for increasing the detectivity of the vapors in the ambient air.

The signal routing is explained in more detail below.

The output signal from the 2-fold amplification circuit 33 is sent to the No.1 input terminal of the and-gate 27; the output signal from the 4-fold amplification circuit 34 is sent to the No.1 input terminal of the and-gate 28; and the output signal from the 6-fold amplification circuit 35 is sent to the No.1 input terminal of the and-gate 29; and the output signals from the and-gates 27,28,29 and 30 are sent, respectively, to the input terminals, 26A, 26B, 26C and 26D of PC26.

When a high value of a fuel vapor is detected by the fuel vapor analyzer 13, a digitized signal of about 5 volt magnitude (termed H-level signal) is sent out from the fuel A/D signal converter 32 to each of the input terminals of circuits 33, 34 and 35 as well as to the input terminal of the and-gate 30. If the spout 9 is out of the spout holder 10, a H-level signal from the start/end analyzer 25 is sent to No.2 terminal of the and-gate 30, which, in turn, sends out another H-level signal to the input terminal of the input section of PC 26.

When a 5-volt signal (H-level) is generated from the fuel A/D signal converter 32, the H-level signal is sent out from each of the amplification circuits 33, 34 and 35 to the respective No.1 input terminals of the and-gates, 27, 28 and 29. If, at this time, a H-level signal from the start/end analyzer 25 is received by No.2 input terminals of the and-gates 27,28 and 29, then a H-level signals are sent to the respective input terminals 26A 26B and 26C of PC26. The result is a recognition by PC 26 that the H-level signals at the input terminals of 26A, 26B, 26C and 26D indicate the presence of gasoline in the fuel tank of a vehicle being supplied with a fuel.

On the other hand, if the fuel vapor analyzer 13 detects a low concentration of fuel vapors, then the fuel A/D signal converter 32 sends out a signal of approximately 1 volt (L-level) to No.1 input terminal of the amplification circuit 33, 34 and 35. If the spout is out of the spout holder 10, then the signal from the start/end analyzer 25 is sent to No.2 input terminal of and-gate 30, which sends out a L-level signal to the input terminal 26D of PC26.

When the fuel A/D signal converter 32 generate a L-level signal, amplification circuit 33 generates a L-level signal while both amplification circuit 34 and 35 generate H-level signals.

The L-level signal generated by the amplification circuit 33 is sent to No.1 terminal of the and-gate 27 while the H-level signals generated by the amplification circuits 34 and 35 are sent to the input terminals of the and-gates 28 and 29.

At this point, when the start/end analyzer 25 sends a H-level signal to No.2 terminal of the logic circuit 27, the said circuit sends out L-level signals to the input terminal 26A of PC 26. When the start/end analyzer 25 sends a H-level signal to No.2 terminals of the logic circuits 28 and 29, then both circuits send out a L-level signals to respective terminals 26B and 26C of PC26.

Accordingly, PC26 concludes that the fuel in the fuel tank of a vehicle being supplied with fuel is light oil based on both the L-level signals present at the terminal of PC26 and 26D and the H-level signals present at the 26B and 26C.

At this time, PC26 makes a decision to supply the fuel i the information at the input terminal of PC 26 matches with the storage fuel information pre-programmed into the pumping station, indicating that the fuel to be supplied is the correct type. At this point, PC26 finally allows initiation of the operation of the fuel pumping motor 3. If the information does not match the pump is shut off.

On the exterior of the pumping station is located a fuel selection control switch 40 for supplying gasoline and a fuel selection control switch 41 for supplying light oil. At the time of the installation of the storage tank in the fuel supply depot, the fuel selection switch 40 is activated if gasoline is to be stored while the switch 41 is activated if light oil is to be stored.

There is a warning device 42, such as flashing red light or buzzer, to warn of discrepancy.

The warning device 42 is activated by warning device circuit (not shown) incorporated in the computing means 24. This device is activated if there is a mismatch in the information concerning the fuel types between the stored fuel and the fuel in the fuel tank of a vehicle; or when the difference existing between the fuel vapor analyzer output and the reference vapor determination exceeds the predetermined allowable range. The warning device is activated to alert the operators.

The above description provides an outline of the operation of the preferred embodiment of this invention. In the following is provided additional information concerning the operational steps of the programmable computers PC26 and PC 31.

Step 1:

PC26 examines whether or not an operator has removed the spout 9 from the spout holder 10, based on the input of the start/end analyzer 25.

Step 2:

After it is confirmed that the spout 9 has been removed from the spout holder 10, the PC power section 31 activates sampling device 14 and the intake pump motor 21 to initiate the intake action shown by the solid arrows in FIG. 2. At this time, a H-level signal, to indicate the removal of said spout 9 from said spout holder 10, is transmitted to No.2 input terminals of the and-gates 27 to 30, inclusively.

Step 3:

Next, the computing means 24 activates the magnetic valves 16A and 17A to open (the magnetic valves 18B and 19B are closed at this time). When the operator inserts the nozzle 9A into the fuel tank of a vehicle, the nozzle position sensor 23 is activated to begin a count of the elapsed time of operation. (This elapsed time is utilized in Step 7).

The intake pump motor 21 now operates to withdraw fuel vapor through the open end of vapor sampling pipe 12 inserted into the fuel tank of the vehicle along with said delivery nozzle 9A, whereby the vapor moves in the direction shown by the solid arrow in FIG. 2. The vapor is transported to a fuel vapor analyzer 13, and is ultimately expelled into the atmosphere through an opening 15A in the vapor routing circuit 15.

Step 4:

Upon completion of the measurement of the fuel vapor concentration with the use of the fuel vapor analyzer 13, the said analyzer transmits an analogue signal, whose intensity level is in proportion to the level of the concentration of the fuel vapor, to the fuel A/D signal converter 32, which converts the analogue signal to a digital form, and transmits the said digital signals (either a H-level or a L-level) to No.1 terminals of the amplifying circuits 33, 34, 36 and the and-gate 30.

The said amplifying circuits 33, 34 and 36 transmit digital signals (either a H-level or a L-level signal), processed by the fuel A/D signal converter 32, to No.1 input terminals of the and-gates 27,28 and 29.

The said and-gates 27, 28, 29 and 30 transmit signals, either H-level or L-level, depending on the input signals stored in the respective No.1 and No.2 input terminals, to the input terminals, 26A, 26B, 26C and 26D of PC26.

The said input section of PC26 examines the input signals stored in the respective input terminals, 26A, 26B, 26C and 26D and, based on the result of the fuel vapor analyzer 13, determines whether or not the vapor level is consistent with the relatively low levels of a light oil type.

Step 5:

If, in step 4, PC26 decides that the reported vapor level is consistent with that for a light oil, based on the information supplied by the fuel vapor analyzer 13, then PC26 retraces the steps outlined in Step 4 paragraph 4 above (that is, PC26 checks whether or not the signals stored in the respective input terminal, 26A, 26B 26C and 26D are H- or L-level signals) and decides whether not the signal level is consistent with that for gasoline.

Step 6:

If, in Step 5, PC26 decides that the signal level transmitted by the fuel vapor analyzer 13 is consistent with that for gasoline, then a gasoline flag is activated, and memorizes a piece of information that the fuel present in the fuel tank of the said vehicle is gasoline.

Step 7:

If, in step 6, the input section PC26 decides that the signal level is not consistent with that for gasoline, then the PC26 triggers an internal clock and wait for at least 5 seconds until the vapor concentration is stabilized in the measuring environment, and PC26 also examines whether or not the elapsed time measured in Step 3 has exceeded 5 seconds.

Step 8:

After the required time interval has passed, PC26 triggers a light oil flag, and memorized a piece of information that the fuel present in the fuel tank of the vehicle is light oil.

Step 9:

The computing means 24 then activates said magnetic valves 16A and 17A to a closed position from an open position.

Step 10:

PC 26 then activates magnetic valves 18B and 19B to an open position from a closed position.

The intake pump motor 21 is then activated to draw in ambient air into the sampling device 14 through pipe 15B in the direction, as shown by solid arrows in FIG. 2, thereby removing the diluted residual fuel vapor remaining within the space of the sampling device 14 through the vapor sampling pipe 12 to be ultimately exhausted into the atmosphere from the opening of the spout 9.

Step 11:

PC26 then proceeds to compare the stored fuel-type memory with the flagged fuel-type information referred to in Step 6, to determine if there is a match between the fuel types of the stored fuel and fuel contained in the fuel tank of said vehicle.

Step 12:

If, in Step 11, PC26 decides that the two pieces of information, the stored fuel and the tank fuel, are consistent, then the output power section of the PC26 activates the fuel pumping motor 3, to supply the type of fuel contained in the fuel tank of the said vehicle.

Step 13:

If, in step 11, the input control PC26 decides that the two pieces of information are not consistent, then PC26 sends a signal to activate the alarm device 42 to alert the operator that the stored fuel type does not match with the fuel type in the fuel tank into which the spout 9 is inserted.

Step 14:

The PC26 then decides whether or not the nozzle spout has been returned to the spout holder 10, based on the input from the start/end analyzer 25; and if PC26 decides that the spout has been returned to the spout holder, then the procedure jumps to Step 19 which will be described later.

Step 15:

The pumping station 1 supplies fuel to the said vehicle when the operator depresses a lever (not shown) of the spout 9 which is inserted into the fuel tank of the said vehicle.

Step 16:

The input control section of PC26 decides whether or not the spout 9 has been returned to the spout holder 10 based on the input signal generated by the start/end analyzer 25.

Step 17:

The output power section 31 of PC26 transmits a signal to fuel pumping motor 3 to cease operation, after recognizing that the spout 9 has been returned to the spout holder 10.

Step 18:

The input control section of PC26 compares the signal levels of the fuel vapor analyzer with those of the ambient vapor analyzer 22.

The said levels of the vapor concentration are those that had been measured by the fuel vapor analyzer 13 in Steps 4 and 5 above; and the level of vapor in the ambient atmosphere measured by the ambient vapor analyzer 22 according to the procedure outlined in Step 10.

Step 19:

The input control section of PC26 then compares the difference between the signal levels from the fuel vapor analyzer 13 and from the ambient vapor analyzer 22 to determine whether the difference lies within the allowable pre-determined range; the value falling within the range is interpreted as a sign of the fuel vapor analyzer being in the proper state of operation to commence next fuel vapor concentration measurements.

Step 20:

If, in Step 19, the input control section of PC26 decides that the said difference in the levels of signals lie within the range of values pre-determined, then the start/end analyzer 25 activates magnetic valves 18B and 19B to change from a closed position to an open position.

Step 21:

The output power section 31 transmits a signal to cease operation of the sampling pump 20.

Step 22:

If, in Step 19, the input control section of PC26 determines that the difference between the signal levels of the fuel vapor analyzer 13 and the ambient vapor analyzer 22 exceeds the pre-determined range, an alarm device 42 is activated to alert the operator that the fuel vapor analyzer is not in proper operating condition, and returns to Step 19.

The preferred embodiment above dealt with an in-ground, fixed-type pumping station; however, the present invention is not restricted to this type only and is applicable also to a suspension type pumping station.

Furthermore, the preferred embodiment above dealt with gasoline and light oil, but the applicability of the invention is not restricted only to the said two types of fuels and it is equally applicable to other types of fuels.

What is claimed is

1. A fuel delivery apparatus for vehicles, equipped with:

(a) a fuel sampling device for measuring concentration of fuel vapor present in a fuel delivery nozzle;

(b) a reference sampling device for measuring concentration of said fuel vapor present in ambient air external to said fuel delivery apparatus;

(c) a fuel type determining means for determining a type of fuel present in a fuel tank based on at least the fuel vapor concentration measured by said fuel sampling device;

(d) a calculating means for calculating a difference between the fuel vapor concentration measured by said fuel sampling device when said fuel delivery nozzle has take out from said fuel tank and that measured by said reference sampling device, after supplying said type of fuel to said vehicle and before supplying a type of fuel to another vehicle; and (e) a warning means for issuing a warning when said difference exceeds a predetermined value.

2. A fuel delivery apparatus according to claim 1 wherein said apparatus is equipped with a fuel sampling pipe having an entry opening adjacent to a fuel delivery nozzle.

3. A fuel delivery apparatus according to claim 1 having a fixed, in-ground fuel storage system.

4. A fuel delivery apparatus according to claim 1, wherein said fuel delivery nozzle is equipped with a nozzle switch and a nozzle holder, such that a motor driver a fuel supplying pump when said fuel delivery nozzle is taken off said nozzle holder and such that said motor stops driving said fuel supplying pump when said fuel delivery nozzle is stored in said nozzle holder.

5. A fuel delivery apparatus according to claim 1, comprising at least one amplifier for amplifying signals generating respectively by said fuel sampling device and said reference sampling device, said signals indicating the respective fuel vapor concentration.

6. A fuel delivery apparatus according to claim 5 wherein said amplifier performs an amplification function of the signals, when the signal indicates that the fuel in the tank is a light oil type.

7. A fuel delivery apparatus according to claim 5 wherein said amplifier performs an amplification function of the signals, when the signal indicates that the fuel in the tank is a light oil type.

8. A fuel delivery apparatus equipped with:

(a) a sampling device for measuring concentration of fuel vapor present in a fuel delivery nozzle and that of said fuel vapor present in ambient air external to said fuel delivery apparatus, said sampling device having a fuel vapor analyzer, a sampling pump motor and a plurality of magnetically-operated valves, wherein said fuel vapor analyzer sensing said fuel vapor, and said magnetically-operated valves being controlled such that said sampling pump motor drives to lead said fuel vapor present in said fuel delivery nozzle to said fuel vapor analyzer at a period for measuring the fuel vapor concentration therein, and such that said sampling pump motor drive to lead said fuel vapor present in ambient air to said fuel vapor analyzer at a period for measuring the fuel vapor concentration therein;

(b) a fuel type determining means for determining a type of fuel present in a fuel tank based on at least the fuel vapor concentration in said fuel delivery nozzle measured by said sampling device;

(c) a calculating means for calculating a difference between the fuel vapor concentration in said fuel delivery nozzle taken out from said fuel tank and that in ambient air measured by said sampling device after supplying said type of fuel to said vehicle, and before supplying a type of fuel to another vehicle; and (d) a warning means for issuing a warning when said difference exceeds a predetermined value.

9. A fuel delivery apparatus according to claim 8 having a fixed, in-ground fuel storage system.

10. A fuel delivery apparatus according to claim 8, wherein said fuel delivery nozzle is equipped with a nozzle switch and a nozzle holder, such that a fuel pumping motor drives a fuel supplying pump when said fuel delivery nozzle is taken off said nozzle holder and such that said fuel pumping motor stops driving said fuel supplying pump when said fuel delivery nozzle is stored in said nozzle holder.

* * * * *

UNITED STATES PATENT AND TRADEMARK OFFICE
CERTIFICATE OF CORRECTION

PATENT NO. : 5,172,738

DATED : December 22, 1992

INVENTOR(S) : Shigemi Komukai, et al.

It is certified that error appears in the above-identified patent and that said Letters Patent is hereby corrected as shown below:

On the title page, "10 Claims, 3 Drawing Sheets", should read --9 Claims, 3 Drawing Sheets--

Column 1, line 40: after "device" insert --.--

Column 6, line 10: "follow" should read --follows--

Column 7, line 29: "i" should read --if--

Column 8, line 51: after "26B" insert --,--

Column 8, line 52: after "whether" insert --or--

Column 10, line 68, Claim 4: "driver" should read --drives--

Column 11, lines 13-16: Please cancel Claim 7, as it is inadvertently a duplication of Claim 6.

Signed and Sealed this

Thirtieth Day of August, 1994

*Attest:*

*Attesting Officer*

Bruce Lehman

BRUCE LEHMAN

*Commissioner of Patents and Trademarks*